US008770313B2

(12) United States Patent
Weddfelt et al.

(10) Patent No.: US 8,770,313 B2
(45) Date of Patent: Jul. 8, 2014

(54) IMPULSE GENERATOR, HYDRAULIC IMPULSE TOOL AND METHOD FOR PRODUCING IMPULSES

(75) Inventors: Kenneth Weddfelt, Stora Mellösa (SE); Göran Tuomas, Örebro (SE); Risto Wisakanto, Fagersta (SE)

(73) Assignee: Atlas Copco Rock Drills AB, Orebro (SE)

( * ) Notice: Subject to any disclaimer, the term of this patent is extended or adjusted under 35 U.S.C. 154(b) by 913 days.

(21) Appl. No.: 11/918,704

(22) PCT Filed: Mar. 20, 2006

(86) PCT No.: PCT/SE2006/000348

§ 371 (c)(1),
(2), (4) Date: Oct. 17, 2007

(87) PCT Pub. No.: WO2006/126928

PCT Pub. Date: Nov. 30, 2006

(65) Prior Publication Data

US 2009/0038817 A1 Feb. 12, 2009

(30) Foreign Application Priority Data

May 23, 2005 (SE) ..... 0501151

(51) Int. Cl.
*B25D 17/02* (2006.01)
*E21B 28/00* (2006.01)
*B25D 9/12* (2006.01)

(52) U.S. Cl.
CPC ..... *E21B 28/00* (2013.01); *B25D 9/125* (2013.01)
USPC ..... 173/144; 173/206

(58) Field of Classification Search
USPC ..... 173/144, 206; 91/50; 175/56
See application file for complete search history.

(56) References Cited

U.S. PATENT DOCUMENTS

| | | | | | |
|---|---|---|---|---|---|
| 2,954,757 | A | * | 10/1960 | Plunkett | 91/25 |
| 3,315,755 | A | * | 4/1967 | Brooks | 175/56 |
| 3,405,770 | A | * | 10/1968 | Galle et al. | 175/56 |
| 3,605,555 | A | | 9/1971 | Wise | |
| 4,308,924 | A | * | 1/1982 | Boguth | 173/135 |
| 4,688,468 | A | * | 8/1987 | Axinti et al. | 91/317 |
| 7,013,996 | B2 | * | 3/2006 | Keskiniva et al. | 175/135 |
| 2006/0157259 | A1 | * | 7/2006 | Keskiniva et al. | 173/1 |
| 2006/0185864 | A1 | * | 8/2006 | Keskiniva et al. | 173/1 |

FOREIGN PATENT DOCUMENTS

| | | |
|---|---|---|
| GB | 1142172 | 2/1969 |
| JP | 04-30974 | 2/1992 |
| WO | 03095153 | 11/2003 |
| WO | 05080051 | 9/2005 |

OTHER PUBLICATIONS

US2004/0226752 A1—Keskiniva et al—filed Nov. 18, 2004.

* cited by examiner

*Primary Examiner* — Thanh Truong
*Assistant Examiner* — Nathaniel Chukwurah
(74) *Attorney, Agent, or Firm* — Mark P. Stone

(57) ABSTRACT

An impulse generator (1) for a percussive tool includes a chamber (3) for receiving a liquid volume and an impulse piston (4) which is arranged for transferring pressure pulses in the liquid volume into stress wave pulses in the tool. The chamber (3) is adapted with respect to its shape such that it forms a resonance chamber for liquid in the liquid volume for forming at least one pressure antinode (11,15,17) inside the chamber. The invention also concerns a method and a hydraulic impulse tool.

16 Claims, 3 Drawing Sheets

IMPULSE GENERATOR, HYDRAULIC IMPULSE TOOL AND METHOD FOR PRODUCING IMPULSES

BACKGROUND OF THE INVENTION

The invention concerns an impulse generator according to the preamble of claim 1. The invention also concerns a hydraulic impulse tool including such an impulse generator and a method for producing impulses.

BACKGROUND TO THE INVENTION

From WO 2005/002802 A1 is previously known an impulse generator, wherein pressure fluid of a pressure which is higher than the pressure in a working chamber is allowed to flow to the working chamber in order to achieve a sudden increase of the pressure therein. Hereby is achieved a force which affects the transmission piston in direction of the tool in order to generate a stress pulse in the tool.

This previously known impulse generator makes necessary the generation and transfer of significant pressures and accurate and quick control means for transferring the pressure between a pressure source and the working chamber, which results in a costly solution. Further there are different kinds of losses involved in said transmission.

AIM AND MOST IMPORTANT FEATURES OF THE INVENTION

It is an aim of the present invention to provide an impulse generator as stated initially wherein the drawbacks of the prior art is avoided or at least reduced.

This aim is achieved in an impulse generator according to the above though the features of the characterizing portion of claim 1. Corresponding advantages are obtained in a hydraulic impulse tool including such an impulse generator and in a method according to the invention.

By adapting the chamber this way it is made possible to influence the liquid in one region of the chamber so that a pressure antinode is formed in a second region thereof. It is further made possible that the impulse piston is subjected to pressure variations or liquid pressure pulses that are present in this pressure antinode. The liquid pressure pulses that act on the impulse piston are subsequently transmitted as pressure tension stress pulses in the tool in order to provide it with movements for i.a. disintegrating of rock.

When the liquid in the chamber is excited at a resonance frequency, a standing wave will thus be formed. The configuration of this wave is i.a. determined by the boundary conditions of the chamber, i.e. its end walls. If the boundary condition is such that an end wall is very rigid, a flow node (no flow variation) and a pressure antinode (maximal varying pressure) will occur at this position. If the boundary condition is non-rigid with respect to the liquid, a flow antinode (maximal varying flow) and a pressure node (no pressure variation) will occur in this position. In the flow antinode, the liquid moves at a maximum, which means that the energy there is bound as kinetic energy. In the pressure antinode, the energy binds as elastic energy.

What characterizes the resonance chamber is therefore that the energy is transmitted as a combination of kinetic and elastic energy.

By forcing one wall of the resonance chamber to move at the frequency that is the same as the resonant frequency of the chamber, said non-rigid boundary condition is met and will therefore at such a position create a flow antinode.

In the second end of the resonance chamber, the chamber wall is essentially rigid, which in practice will form the above mentioned rigid boundary condition for the liquid, with the forming of said pressure antinode as a consequence. In the pressure antinode the pressure ideally varies with sine form, over time, i.e. symmetrically around a mean pressure. Maximal pressure variation in this position can thus be between zero and double the mean pressure.

In practice the pressure will vary somewhat also at the pressure node side. This variation can, however, be made as small as desired or as small as can be accepted by influencing the height of the resonant peak. This can be achieved by adapting the impedances of the drill string, the resonance chamber and the pump for feeding the resonance chamber.

The parameters influencing the resonant frequency inside the chamber are essentially: the length of the chamber, the boundary conditions, the density and the compressibility modulus of the liquid and to a certain extent also the cross sectional dimensions of the chamber.

It is preferred that liquid is fed in/out through inlet/outlet to the chamber, which makes a solution possible, which is economic and realistically handled.

By a number of liquid inlets/outlets being distributed over the circumference of the chamber, it is possible to evenly distribute the input/output of liquid and also to use several liquid pumps/sources in order to achieve a quick response and smaller losses.

Generally, a solution according to the invention is lenient to the components involved, since at the inlet side there prevails an essentially constant counter pressure that meets the liquid source, which in particular is comprised of one or several pumps. It can therefore be expected that each pump has a relatively low degree of load and thereby a long life time.

Only as an example it can be mentioned that typical values of pressures can be such that input is at about 225-275 bar, that the average pressure $P_0$ is 250 bar and that the pressure on the impulse piston thus in the simplest case varies between about 0 and 500 bar.

In particular it is preferred that the chamber is adapted such that in operation there is quarter wave resonance or odd multiples of quarter wave resonance. Suitably the chamber is adapted for a frequency of between about 200 and 1000 Hz. Other frequencies can, however, also be used.

By the chamber having a circular cross section, manufacture is simplified. This shape is also the most effective and most free from losses for the (resonance) chamber.

Shaping the chamber with a linear extension gives possibility of a slender shape which is to be preferred in many applications. Shaping of the chamber with a bent extension makes it, however, possible to limit its total length.

By the chamber being changeable with respect to its shape and in particular length changeable, there is achieved the possibility of controlling the resonant frequency, which can be advantageous in working in different materials etc.

By arranging by the impulse piston an impulse chamber which is separate from the (resonance) chamber, whereby channel means are arranged between the chambers, it is possible to separate the resonance chamber and the parts having direct connection to the tool itself.

By arranging valve means for controlling the flow in said channel means, advantageous adjustments of the configuration of the pulse affecting the impulse piston is possible. Hereby the pulse can be controlled such that its shape deviates from the otherwise prevailing sine-shape, and for example be formed so as to minimize reflection effects from influenced rock or the like.

By using a plurality of resonance chambers mutually connected in series, pulse amplitudes can for example be affected, in particular be raised more than what would otherwise be possible when using a system with one resonance chamber.

The corresponding advantages are achieved with respect to the corresponding method claims and further advantages are obtained through the feature of the other independent claims.

BRIEF DESCRIPTION OF DRAWINGS

The invention will now be described in greater detail at the background of embodiments and with reference to the annexed drawings, wherein.

DESCRIPTION OF EMBODIMENTS

Figure 1:
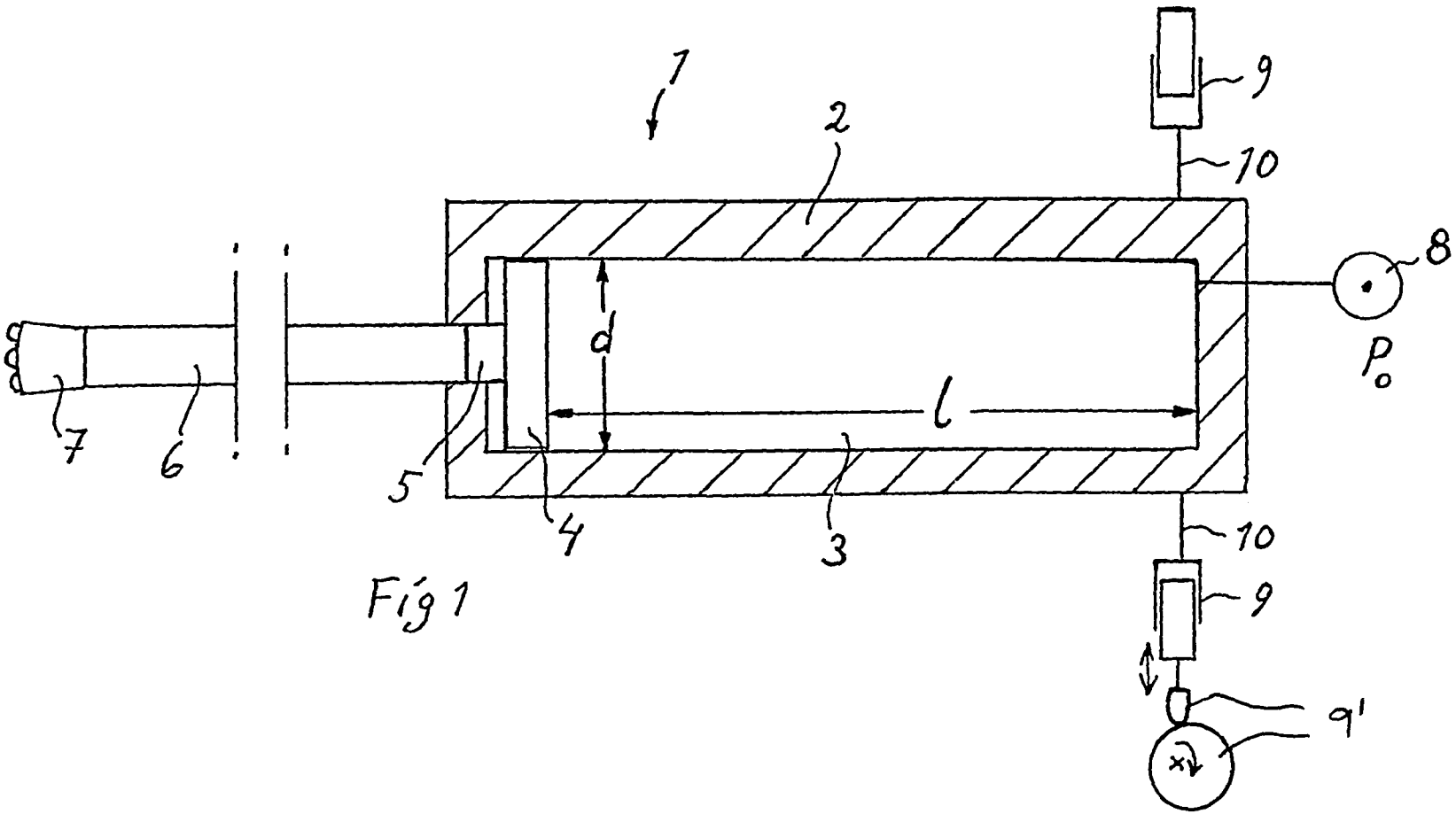
FIG. 1 diagrammatically shows a rock breaking tool including an impulse generator according to the invention.

In FIG. 1, reference numeral 1 generally concerns a rock breaking tool which includes a housing 2 for receiving a volume of liquid in a chamber 3, in the one end of which is arranged an impulse piston 4. This lies via a rod shaped portion 5 directly against a rock breaking tool 7 over a drill rod 6.

The chamber 3 is formed to its shape with a length l and a diameter d and is filled with a chosen liquid, whereby when the same liquid is periodically fed in through liquid inlet/outlets 10 from pumping devices 9, the liquid inside the chamber 3 will be put into a state of resonance. In particular in such a way that a pressure node will be present in the area of the inlets/outlets 10 and that a pressure antinode will be present in the area of the impulse piston 4 and acting thereon. The pumping device 9 is arranged to be driven by a cam-follower arrangement designated by 9' in FIG. 1.

With reference numeral 8 is indicated a source for providing a constant mean pressure inside the chamber 3 around which mean pressure the pressure inside the resonance chamber will fluctuate. This arrangement will also guarantee that possibly leaking liquid is replaced inside the system.

F indicates a feed force acting on the rock breaking tool 1, for example from a conventional feeder which is arranged on a feeding beam of a drill rig.

Figure 2:
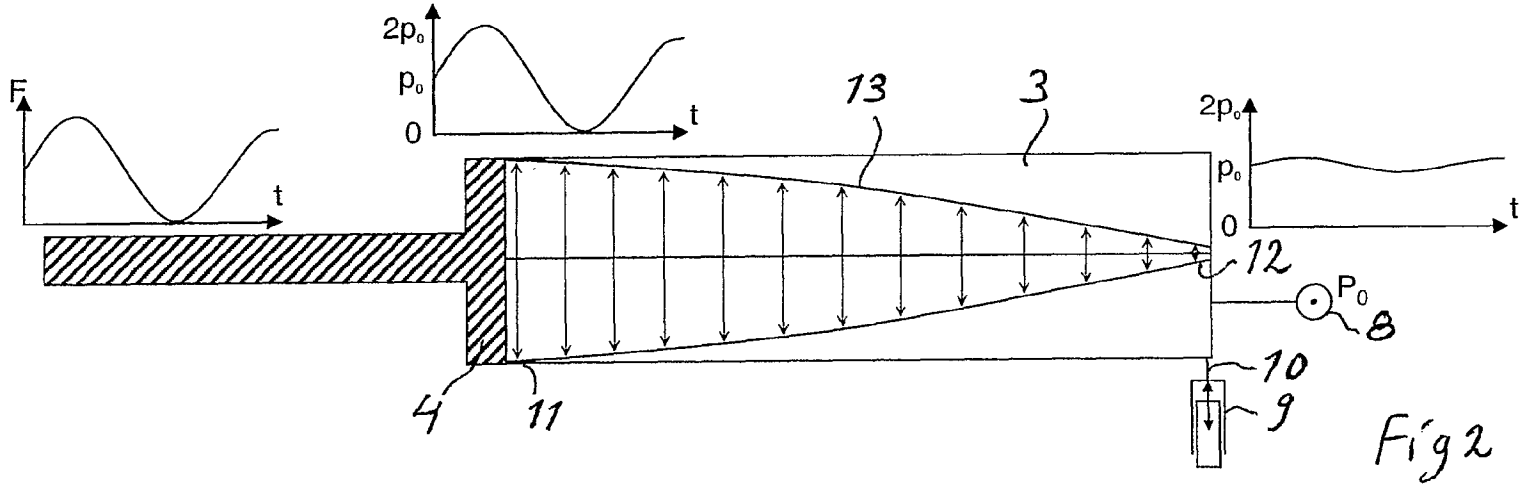
FIG. 2 shows diagrammatically the pressure distribution obtained in a resonance chamber of an impulse generator according to the invention.

In FIG. 2 is diagrammatically shown the pressure distribution in resonance of the liquid in the chamber 3 in operation of the device and with periodic input pumping from the pump 9 of liquid through a liquid inlet/outlet 10. The pressure distribution is shown with an upper curve 13, illustrating the amplitude over the length of the constituted resonance chamber 3, with a pressure node 12 and a pressure antinode 11. Further, because of the pressure source 8, there prevails a mean pressure $P_0$, around which the pressure varies inside the resonance chamber.

The greatest pressure amplitude thus occurs in the pressure antinode 11 in the region of the impulse piston 4, onto which the pressure at this end of the resonance chamber is transmitted for further transfer as a pressure tension wave or a stress wave through the rod shaped part thereof and further through the tool. It should be noted that the movement of the piston 4 in the axial direction, the length direction of the chamber, is small in connection with the transfer of the pressure pulse as a stress wave in the tool. Further, it can be mentioned that the energy is transferred directly as stress wave energy and not as kinetic energy from the impulse piston to the tool.

In FIG. 2 is also placed three diagrams, whereof the right one illustrates the pressure variation in the area of the pressure node 12. As is shown, in practice here prevails a certain smaller pressure variation, which deviates from an ideal case, where the pressure variation should be zero in this position. This minor variation is, however, tolerable and in practice not detrimental for the function of the impulse generator.

The diagram at the tool end of the resonance chamber 3 illustrates the pressure variation prevailing at the pressure antinode 11. This is thus in this case such that it varies sine-shaped around the mean value $P_0$ with the amplitude $P_0$. This way the impulse piston 4 in this example is influenced by pressures between 0 and $2P_0$. It should be observed that other pressure relations between amplitude and $P_0$ is within a scope of the invention.

The F-t-diagram at the far left shows the force being transferred over the impulse piston 4 as function of time. The force F varies sine-shaped between 0 and a certain maximum value of F.

For the frequency f the following is essentially valid with respect to FIG. 2: $4 \cdot l \cdot f = c$; where l is the length of the chamber and c is the speed of sound.

Figure 3:
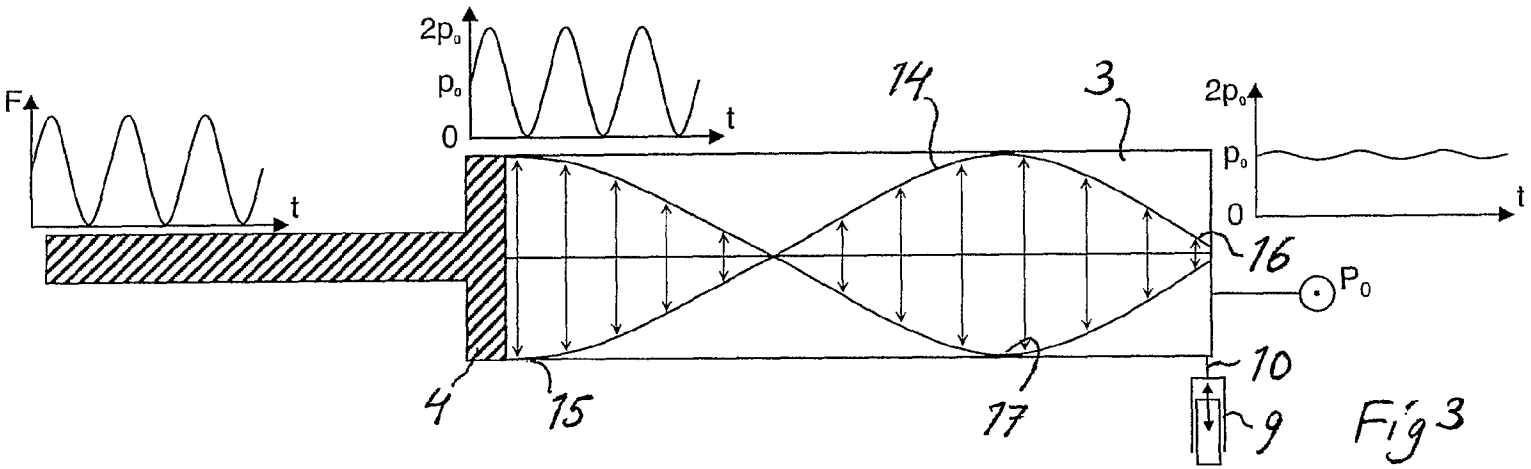
FIG. 3 shows diagrammatically a variant of the pressure distribution in an impulse generator according to the invention.

FIG. 3 illustrates an operating example where the frequency has been increased such that three quarter wave resonance prevails inside the resonance chamber 3. The pressure variation is illustrated with the curve 14 and it still exist a pressure node 16 in the area of the inlet/outlet 10. As before it exists a pressure antinode 15 in the area of the impulse piston 4. Further, in this case there exists also a pressure antinode 17 essentially at a third part distance from the input side.

The two diagrams at the right of FIG. 3 illustrate the pressure distribution at the inlet and at the impulse piston 4. The F-t-diagram shows the force distribution which will influence the tool. In this case the impulse frequency will thus be three times as great as according to the operating example in FIG. 2.

For the frequency f, the following is valid with respect of FIG. 3: $4 \cdot l \cdot f = n \cdot c$; where l is the length of the chamber, c is the speed of sound and n=1, 3, 5, 7 . . . . In FIG. 3 n=3.

Figure 4:
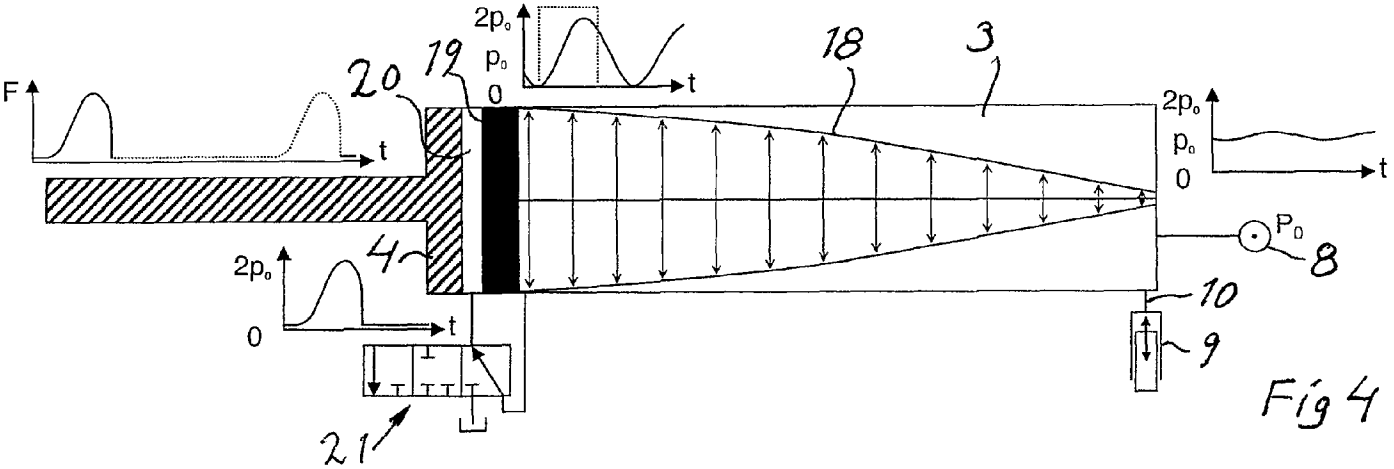
FIG. 4 shows diagrammatically a variant of the pressure distribution in a second impulse generator according to the invention.

In FIG. 4 a variant is shown which differs from the one shown in FIG. 2 by the fact that a rigid intermediate wall 19 has been placed in the position of the impulse piston 4 in FIG. 2. The impulse piston 4 has instead been moved to the left, as seen in the Figure and between the impulse piston 4 and the intermediate wall there has been arranged an impulse chamber 20, which in chosen positions is in connection with the part of the resonance chamber 3 that is closest to the intermediate wall 19.

This way the shape of the pressure pulses that are transferred to the impulse chamber 20 can be controlled such that they correspond to a stress wave propagation that is desired in the tool. Between the resonance chamber 3 and the impulse chamber 20 there is a valve device 21, which is arranged in channel means and is controllable for connection between these chambers or for cutting off the connection between them. Further, the valve device 21 is capable of evacuating the impulse chamber 20.

In the shown example, the resonance chamber 3 is connected to the impulse chamber 20 during a rising portion of the pressure curve but be cut off slightly after the amplitude peak. This result in a curve shape having an extended rising portion as seen over time but with an abrupt cut off, which can give a very suitable force distribution in the tool in order to, for example, resist reflections from rock to be worked. It should be noted that the pulse shape this way can be controlled into all kinds of configurations. In particular it is often desirable to optimize the shape for minimizing reflections in the tool. Hereby the rising as well as the descending flange can be adapted to come close to this aim. Another aspect is the possibility of having a pulse frequency which is lower than the resonance frequency, for the adjustment to different working situations.

The two diagrams to the right correspond to the ones in FIG. 2. With interrupted lines in the upper of these ones is indicated when the valve 21 leaves the connection between the chambers open.

The smaller diagram close to the valve 21 shows an example of a curve shape being formed this way. The F-t-diagram shows the shape of the resulting stress wave.

Figure 5:
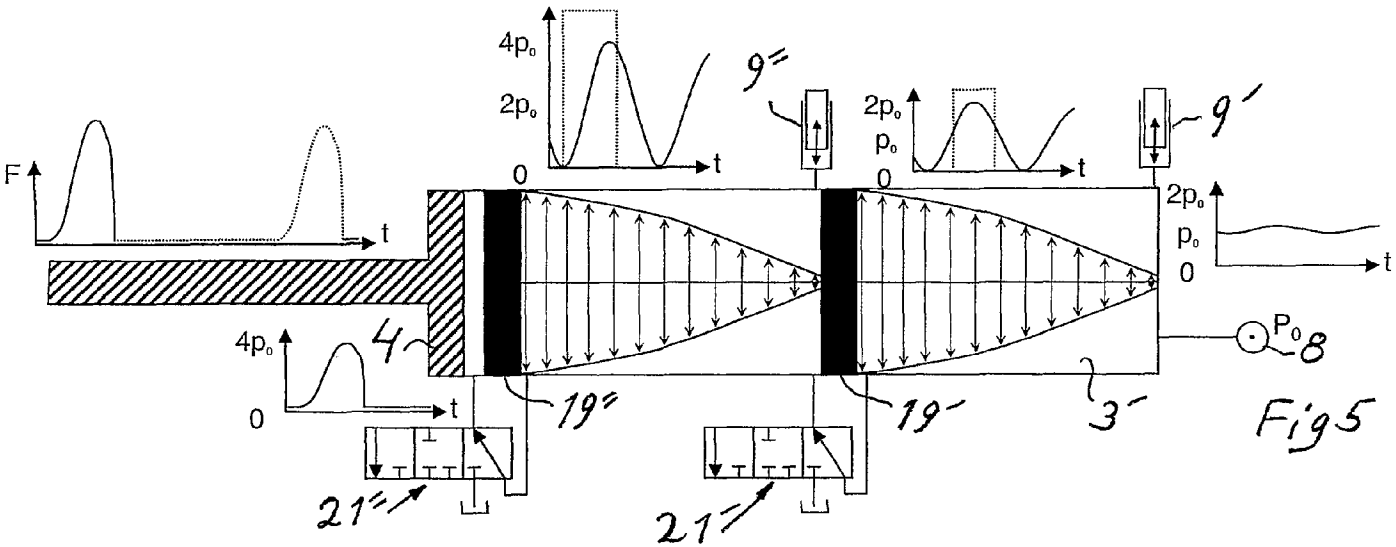
FIG. 5 shows diagrammatically a variant of the pressure distribution in a third impulse generator according to the invention.

FIG. 5 shows two resonance chambers 3' and 3" which are separated by a wall 19' but are series connected, and which are mutually interconnected over a channel with a valve 21', and which each has a pumping device 9' and 9". The details 19" and 20' correspond to the details 19 and 20 respectively in FIG. 3. The channel between the chambers 3' and 3" is controllable with the valve 21' generally according to what is true for the valve 21 above. The same applies for the valve 21". In this case, as an example, and which is shown in the F-t-diagram, a more steep pulse is obtained. The meaning of the diagrams is easily understood on hand of the description of previously discussed diagrams.

By suitable control of valves, corresponding to 21, 21' and 21", suitable pulse shapes and stress wave shapes can be obtained. For example, the valves can be controlled such that they work with controlled opening and closing characteristics respectively in order to thereby obtain desired shapes. Minimizing reflections in the tool is possible to achieve this way. As an alternative or complement thereto, a connection between a resonance chamber and an impulse chamber such as in FIGS. 4 and 5 can include a plurality of channels with different length and/or areas. By choice of channel or channels, through which connection shall be established, the progressiveness in the pressure increase in the impulse chamber can be controlled and thereby the shape of the stress wave in the tool be controlled such that it gets a desired progressive flank shape. This gives the possibility of increasing the efficiency of the device. In practice this can be achieved by, as an example, arranging parallel conduits between the chambers 3 and 20 in FIG. 4, whereby these channels are adapted as is indicate above. The channels can be opened/closed with the aid of valves corresponding to the valve 21 in FIG. 24. As further alternatives, the channels can be adjustable to there lengths. This can be obtained in different ways, for example by telescopingly displaceable U-pipes, displaceable sleeves in a chamber 3 and/or 4 etc.

The invention can be modified within the scope of the claims. The construction of the device can thus be modified further. For example, the liquid can be influenced in other ways than through the ones that are shown. One example of this is to have a physically moveable wall moving with a certain frequency instead of a pumping arrangement. Other types of pumps and valves can also come into question. The pressure node can be arranged separate from a wall of the chamber. It is not excluded that the resonance chamber at the same time is fed with/influenced by different frequencies in order to obtain simultaneous resonance at different frequencies in order to achieve a desired effect on the tool.

The chamber can be made changeable to its shape so that the resonant frequency is controllable. In its simplest way it is made length changeable by having a rear wall displaceable inside a cylindrical tube forming the chamber.

Different liquids can be used, in particular is preferred a liquid from the group; water, silicon oil, hydraulic oil, mineral oil.

The invention claimed is:

1. Method for producing impulses for a percussive tool including a chamber for receiving a liquid volume and an impulse piston which is arranged for transferring pressure pulses in the liquid volume into stress wave pulses in the tool, the steps of said method comprising periodically influencing liquid in the chamber for setting the liquid volume in resonance for forming at least one pressure antinode in the chamber.

2. Method according to claim 1, wherein the liquid in the chamber is influenced periodically by input and output of liquid to the chamber with a certain frequency.

3. Method according to claim 2, wherein liquid is fed in to and fed out from the chamber through a plurality of liquid inlets/outlets which are distributed over the circumference of the chamber.

4. Method according to claim 3, wherein a pressure node is arranged to be formed in the region of said liquid inlets/outlets and a pressure antinode with the greatest pressure amplitude in the region of the impulse piston.

5. Method according to claim 1, wherein liquid is fed in to and fed out from the chamber through a plurality of liquid inlets/outlets which are distributed over the circumference of the chamber.

6. Method according to claim 5, wherein a pressure node is arranged to be formed in the region of said liquid inlets/outlets and a pressure antinode with the greatest pressure amplitude in the region of the impulse piston.

7. Method according to claim 1, wherein the resonance is generated such that in operation quarter wave resonance or odd multiple of quarter wave resonance prevails.

8. Method according to claim 1, wherein the frequency is controlled to be between about 200 and 1000 Hz.

9. Method according to claim 1, wherein liquid is fed in distributed over the circumference of the chamber.

10. Method according to claim 1, wherein the shape of the chamber is changed in order to control the resonance frequency.

11. Method according to claim 10, wherein the length of the chamber is changed.

12. Method according to claim 1, wherein pressure pulses are transferred to an impulse chamber which is positioned at the impulse piston, and which is separate from the chamber, over a channel arranged between the chamber and the impulse chamber.

13. Method according to claim 12, wherein the flow in said channel is controlled.

14. Method according to claim 12, wherein length or area of said channel is adjusted for controlling the shape of said stress wave pulses.

15. Method according to claim 1, wherein pressure pulses are transferred between a plurality of mutually series connected chambers.

16. Method according to claim 1, wherein a liquid from the group: water, silicon oil, hydraulic oil, mineral oil is used.

* * * * *